US006516600B2

(12) United States Patent
Paweletz

(10) Patent No.: US 6,516,600 B2
(45) Date of Patent: Feb. 11, 2003

(54) ROTARY DRIVE FOR A SPINNING ROTOR DURING ITS CLEANING

(75) Inventor: Anton Paweletz, Fellbach (DE)

(73) Assignee: W. Schlafhorst AG & Co. (DE)

( * ) Notice: Subject to any disclaimer, the term of this patent is extended or adjusted under 35 U.S.C. 154(b) by 0 days.

(21) Appl. No.: 10/045,938

(22) Filed: Oct. 24, 2001

(65) Prior Publication Data

US 2002/0073685 A1 Jun. 20, 2002

(30) Foreign Application Priority Data

Oct. 24, 2000 (DE) ..... 100 52 672

(51) Int. Cl.[7] ..... D01H 11/00
(52) U.S. Cl. ..... 57/302
(58) Field of Search ..... 57/301, 302, 303, 57/263, 304

(56) References Cited

U.S. PATENT DOCUMENTS 4,125,991 A * 11/1978 Stahlecker ..... 57/302
4,135,354 A * 1/1979 Stahlecker ..... 57/302
4,315,399 A * 2/1982 Pfeifer et al. ..... 57/302
4,548,030 A * 10/1985 Lauschke et al. ..... 57/301
4,897,993 A * 2/1990 Raasch et al. ..... 57/302
5,083,421 A * 1/1992 Raasch et al. ..... 57/301
5,609,015 A * 3/1997 Raasch et al. ..... 57/302

FOREIGN PATENT DOCUMENTS

DE 33 13 926 A1 10/1984
DE 26 29 161 C2 11/1986
DE 35 30 879 A1 3/1987
DE 37 15 934 A1 11/1988
DE 44 11 343 A1 10/1995

* cited by examiner

*Primary Examiner*—Danny Worrell
(74) *Attorney, Agent, or Firm*—Kennedy Covington Lobdell & Hickman, LLP

(57) ABSTRACT

For cleaning of a spinning rotor independently of the support of the spinning rotor, a rotary drive (4) is selectively movable into and out of contact with an outer rotor surface via entraining elements (7) for imparting rotary movement to the spinning rotor (1). The entraining elements (7) are arranged such that radial forces produced by the contact are mutually cancelled. The entraining elements (7) are advantageously attached directly to the electric rotor (9) of the rotary drive (4).

11 Claims, 4 Drawing Sheets

ROTARY DRIVE FOR A SPINNING ROTOR DURING ITS CLEANING

CROSS-REFERENCES TO RELATED APPLICATIONS

This application claims the benefit of German patent application DE P 10052672.1, filed Oct. 24, 2000, herein incorporated by reference.

BACKGROUND OF THE INVENTION

The present invention relates to a rotary drive for use in conjunction with an arrangement for cleaning a spinning rotor having a tool for introduction into the rotor for cleaning contact with an interior rotor surface to be cleaned.

Open-end rotor spinning machines are used almost exclusively to process cotton fibers or fiber blends containing cotton fibers as their main component. However, natural fibrous materials contain impurities that in some instances can have a significant adhesive character, such as, e.g., pectin, wax, and the like which occur naturally in the cotton fibers. These impurities tend to become deposited in the rotor groove. As a result, the rotor groove becomes increasingly clogged over time, which distinctly reduces the spinning stability and the quality of the yam produced. For this reason, these impurities are usually removed from the rotor upon a yarn break before spinning is restarted. Moreover, it is possible to perform a preventive cleaning, which is especially necessary if yarn breaks or other interruptions seldom occur. In this instance, the spinning process is purposely interrupted in order to perform this cleaning.

Many variants of this cleaning process, as well as the devices used for the cleaning process, constitute the subject matter of a great number of patent applications.

German Patent Publication DE 26 29 161 C2 describes a maintenance device for the spinning units of an open-end rotor spinning machine in which various cleaning tools, such as scrapers, brushes or blowing nozzles, are used. These cleaning tools are attached to a rotatable shaft that is moved along the rotor shaft for the cleaning process until the cleaning tools have passed the rotor opening and reached the plane of the rotor groove. However, since the rotor opening has a smaller diameter than the rotor groove (which is at the location of the greatest rotor diameter), the cleaning tools may not have sufficient radial extension from the rotor shaft required to reach the groove after passing the rotor opening. This situation was improved by fastening the cleaning tools to spring elements that are bent outward during the rotation of the shaft carrying the cleaning tools by the centrifugal forces occurring thereby until the cleaning tools make contact with the rotor groove.

This improvement however has the particular disadvantage that the cleaning tools are deflected radially and tangentially when they meet impurities until they are free of the impurity. The tools thereby start to oscillate, which prevents their proper contact with the rotor groove, which contact should be as long as possible for a complete cleaning. In addition, the force directed in this manner against the impurities is limited and thus does not lead to the desired cleaning result. First and foremost, however, rotating cleaning elements tend to accumulate fiber windings. This problem causes the tools to become constricted to the point that the tools may no longer be able to extend outwardly in the required manner at the next cleaning process.

German Patent Publication DE 35 30 879 A1 teaches a method and a device for rotor cleaning that makes use of a rotatable blower device corresponding with a suction bell also present otherwise in German Patent Publication DE 26 29 161 C2. Only impurities which are fairly easily detachable can be eliminated by the exclusive use of compressed air. On the other hand, stubborn impurities can only be detached from the surface of the rotor groove by a mechanical method.

In order to counter these disadvantages, German Patent Publication DE 37 15 934 A1 teaches a cleaning device in which the rotor itself is caused to rotate by a drive roller that can be placed laterally on the outer side of the rotor whereas a mechanical cleaning tool in the form of a scraper is shifted obliquely through the rotor opening into the rotor groove and then held in contact with the rotor groove. Even stubborn impurities can be readily eliminated by such a scraper.

The above device has the disadvantage, however, that radial forces are exerted on the rotor during the drive that can result in a varying deflection of the rotor as a function of the design of the radial support. This problem is especially critical if the rotor is supported in a non-contact manner, e.g., by magnetic and/or gaseous support. In addition, the maintenance unit and the rotor are not always aligned totally identically to one another. In this instance, a reinforcement of this deviation can result on account of the radial forces. This problem can also have the result, among other things, that the contact of the cleaning tool with the rotor groove is not intensive enough or at least not uniform enough to perform an unobjectionable rotor cleaning.

SUMMARY OF THE INVENTION

The present invention therefore has the object of further improving the above-described state of the art and, in particular, to provide for improved rotor cleaning.

The invention addresses this object by an improved rotary drive for use in conjunction with an arrangement for cleaning a spinning rotor having a tool for introduction into the rotor for cleaning contact with an interior rotor surface to be cleaned. According to the present invention, the rotary drive comprises an entraining device for contact with an exterior rotor surface for imparting rotary movement to the spinning rotor during cleaning, the entraining device being arranged relative to the spinning rotor to mutually cancel radial forces generated by the rotary drive and the spinning rotor by the contact therebetween when the rotary drive and the spinning rotor respectively rotate about a common axis of rotation.

Due to the arrangement of the entraining device in accordance with the present invention, the spinning rotor is not exposed to any radial force while being driven by the rotary drive for rotor cleaning if the axes of the rotary drive and of the spinning rotor are in alignment. Possible slight errors of adjustment are in a range of 1 mm and do not result in the generation of disturbing radial forces. Such minor misalignment can be compensated, e.g., by an appropriate degree of play in the suspension of the rotary drive or by an elasticity of the mounting of the entraining device or of the entraining device itself. Optionally, a mutual centering between the rotary drive and the spinning rotor can also take place during the driving of the rotor.

The entraining device preferably comprises one or more entraining elements, e.g., a closed ring or several entraining elements arranged on a circular support. The decisive factor is that the ring or the circular support is arranged at a right angle to the axis of the rotor shaft in order to assure the required centering. In any case, the arrangement should be selected so that no resulting radial forces remain.

The entraining elements are advantageously attached directly on the electric rotor of the rotary drive, that is preferably designed as an outside rotor motor.

In order to assure an effective driving engagement of the spinning rotor, the entraining elements preferably have an anti-slip gripping surface at least on the portion thereof which contacts the spinning rotor. Entraining elements comprised of an elastic material are especially suitable in order to also assure that cleaning tools arranged on the same advancing element can be exactly positioned so that they meet the rotor groove.

If the entraining elements comprise, e.g., rubber magnets, no pressure or force need be exerted via the advance of the rotor drive unit because the entraining elements are thereby coupled by magnetic force to the ferromagnetic spinning rotor.

In order to be able to bring the entraining elements and the cleaning tools in contact with the rotor, a positioning device is utilized to shift the entire cleaning device axially to the spinning rotor. This positioning device preferably has a control device that makes possible an exact positioning relative to the spinning rotor.

However, it is alternatively contemplated under the present invention that the cleaning tool can shift axially relative to the rotary drive so that the contacting of the entraining elements with the rotor and the immersion depth of the cleaning tool into the rotor opening can be separately controlled.

According to a further feature of the invention, the spinning rotor is freed from an axial force component during its drive for cleaning the rotor since an axial contract pressure is not necessary when the spinning rotor is engaged between the entraining elements.

The invention is explained in further detail in the following description with reference to exemplary embodiments illustrated in the accompanying drawings.

DESCRIPTION OF THE PREFERRED EMBODIMENT

Figure 1:
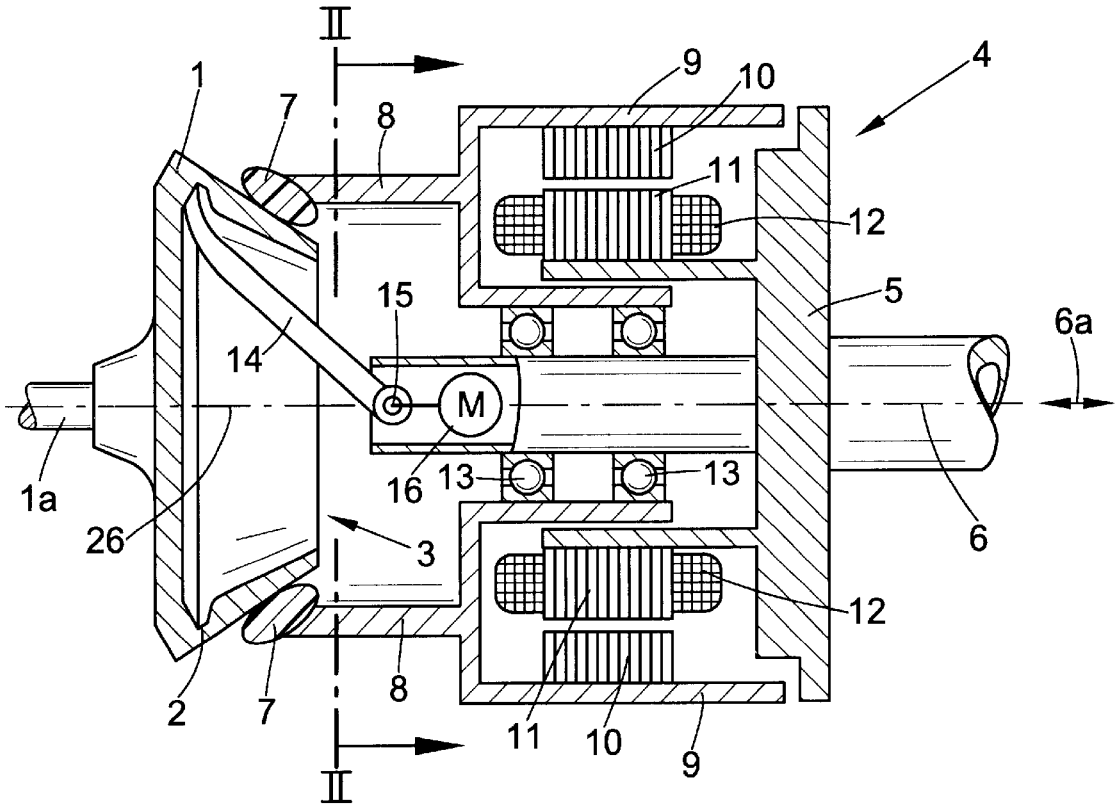
FIG. 1 is a sectional view through a rotary drive for a spinning rotor during its cleaning, in accordance with the present invention.

Referring now to the accompanying drawings and initially to FIG. 1, a spinning rotor 1 is shown in association with a rotor drive unit 4 according to the present invention. Spinning rotor 1 comprises rotor shaft la that serves to support the spinning rotor. Such a support can be a known support disk support, a magnetic support or a pneumatic support. Rotor drive unit 4 is advantageously arranged on a maintenance device (not shown) that can travel along a rotor spinning machine.

Double arrow 6*a* indicates that the entire rotor drive unit 4 is arranged on the maintenance device so that it can be shifted toward and away from the rotor 1 along the axis of the rotor shaft. At the same time, this double arrow 6*a* also symbolizes a positioning device (not shown) on the maintenance device that makes possible an exact positioning of rotor drive unit 4 by means of a control device (also not shown). For example, a stepping motor that acts on a threaded spindle or via a worm drive on a toothed rack would also be conceivable for such a shifting device.

The rotor drive unit 4 includes drive housing 5 that carries stator 11 with stator winding 12. Stator 11 or stator winding 12 corresponds to rotor magnetic arrangement 10 attached to electric rotor 9 of rotor drive unit 4 designed in its entirety as an outside rotor motor. Electric rotor 9 is supported via support 13 on a central part of drive housing 5.

Pot-shaped holder 8 carrying annular, elastic entraining element 7 is attached to the portion of electric rotor 9 which faces spinning rotor 1.

During the advance 6*a* of rotor drive unit 4 in the direction of spinning rotor 1 the annular entraining element 7 is placed on the conical outside surface of spinning rotor 1. It is possible, as a result of an elastic design of entraining element 7, to control the frictional force between entraining element 7 and the conical outer surface of spinning rotor 1 within relatively broad limits by means of a varying limitation of the advance.

A cleaning element in the form of a scraper 14 is pivotable about scraper shaft 15. The pivot drive is effected by stepping motor 16. This stepping motor 16 is coordinated with the advancing motion of the entire rotor drive unit 4 in the present example in such a manner that scraper 14 first passes axially through rotor opening 3 without problems but is then pivoted radially outward rapidly enough to enter rotor groove 2, if possible without touching the rotor bottom.

It is alternatively conceivable that scraper shaft 15 can shift axially within drive housing 5 in order to enable the adjustment of scraper 14 independently of the position of rotor drive unit 4. Stepping motor 16 could be additionally used for this advancing motion e.g., by engagement with a worm in a cogging within drive housing 5. The stepping motor would then axially shift itself as well as scraper shaft 15 with scraper 14. However, as will be appreciated, any other desired linear drive is also conceivable for this purpose.

Figure 2:
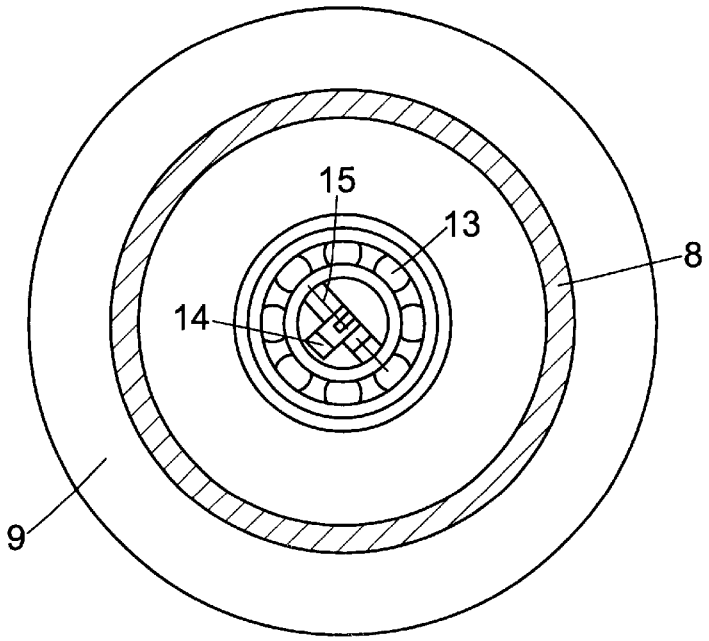
FIG. 2 is a sectional view along line II—II of FIG. 1.

FIG. 2 shows the annular holder 8 in section.

Figure 3:
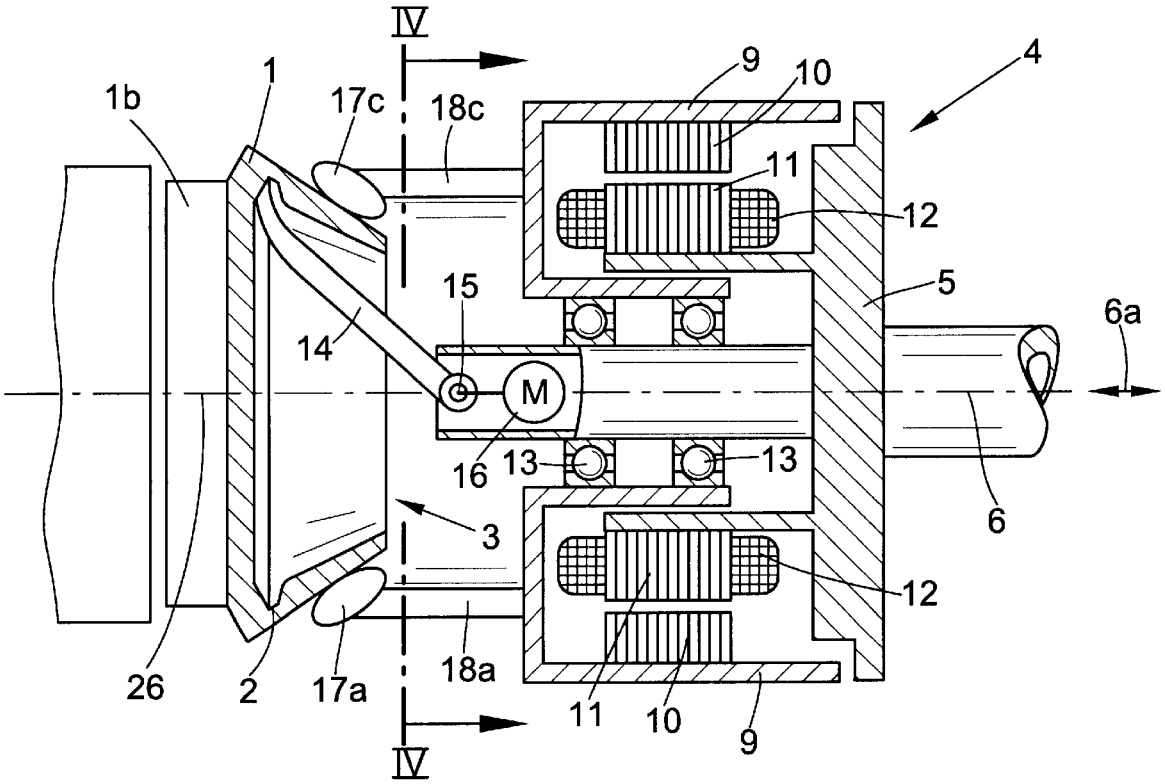
FIG. 3 is another sectional view similar to FIG. 1 through a rotary drive for a spinning rotor during its cleaning, in accordance with a variant of the present invention.
Figure 4:
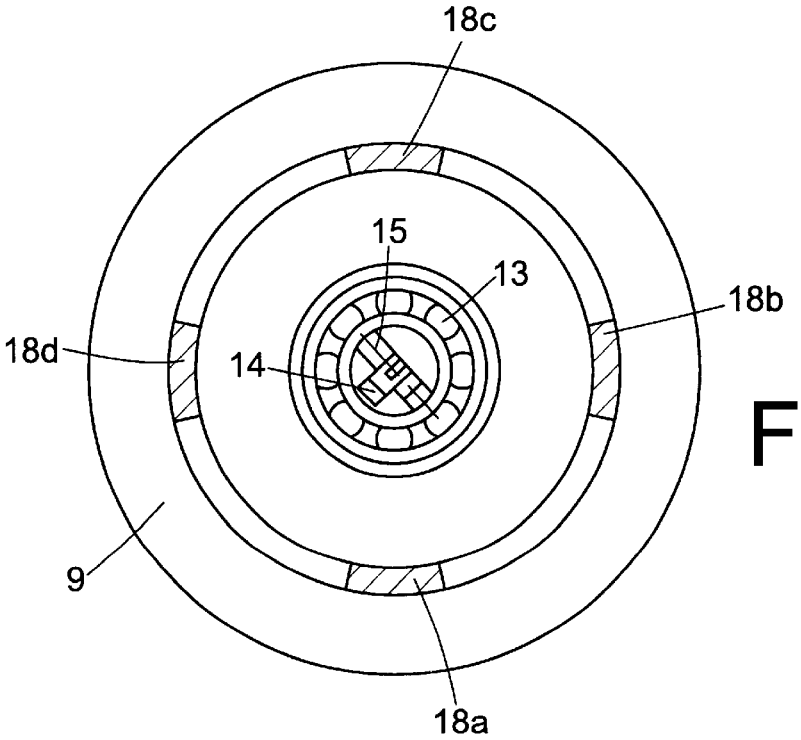
FIG. 4 is a sectional view along line IV—IV of FIG. 3.

The embodiment of the present invention shown in FIGS. 3 and 4 differs from the first embodiment, on the one hand, in that spinning rotor 1 is not provided with a rotor shaft but rather is coupled to electric rotor 1*b* that is a component of a magnetic support/gas support as is known, e.g., from German Patent Publication DE 42 07 673 C1. It is particularly important in such a support that, to the extent possible, no very large radial forces occur during the driving of the spinning rotor during the cleaning process since the magnetic centering of electric rotor 1*b* has only limited capability to resist such radial forces.

In the embodiment of FIGS. 3 and 4, pot-shaped holder 8 of the first exemplary embodiment is replaced by four holders 18*a* to 18*d* spaced uniformly in a circular arrangement. Entraining elements 17*a* to 17*d* are arranged on holders 18*a* to 18*d*, of which elements only entraining elements 17*a* and 17*d* are shown in FIG. 3. The action of these entraining elements 17*a* to 17*d* corresponds to that of annular entraining element 7, since radial force components can be cancelled just as effectively by the uniform distribution of the entraining elements 17*a* to 17*d*.

Figure 5:
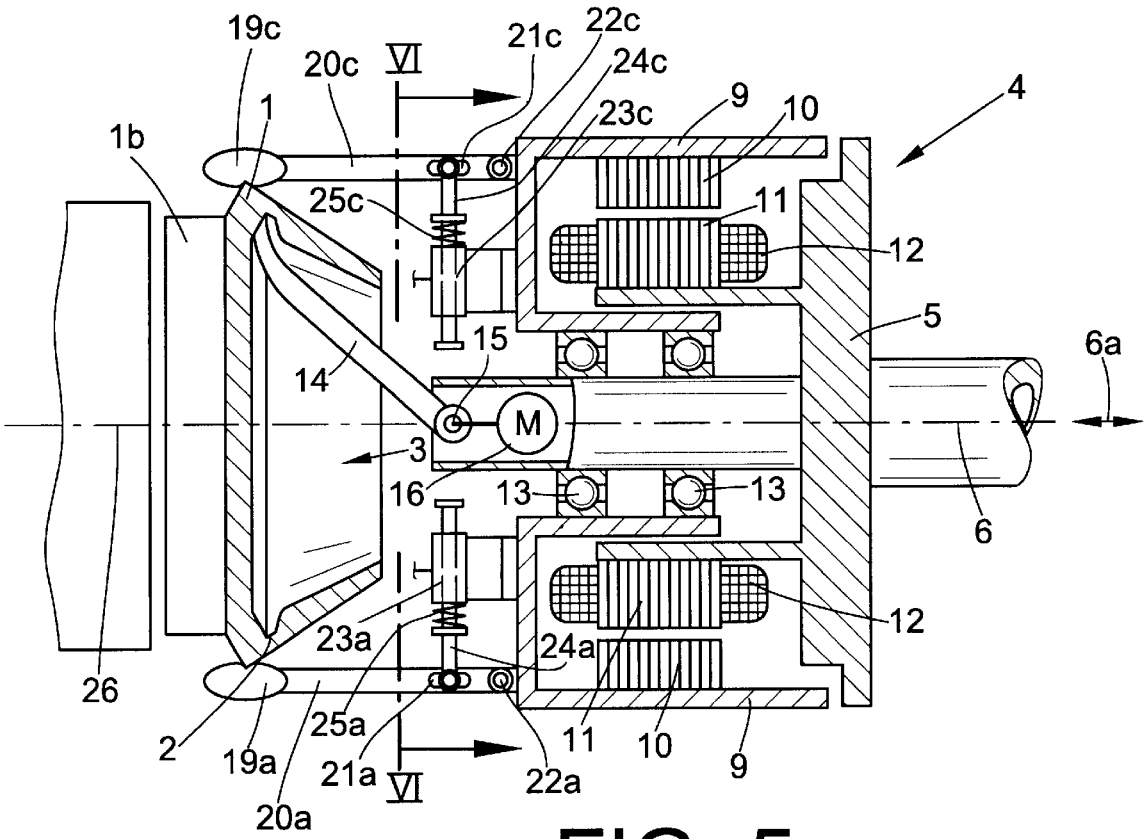
FIG. 5 is another sectional view similar to FIGS. 1 and 3 through a rotary drive for a spinning rotor during its cleaning, in accordance with a third variant of the present invention.
Figure 6:
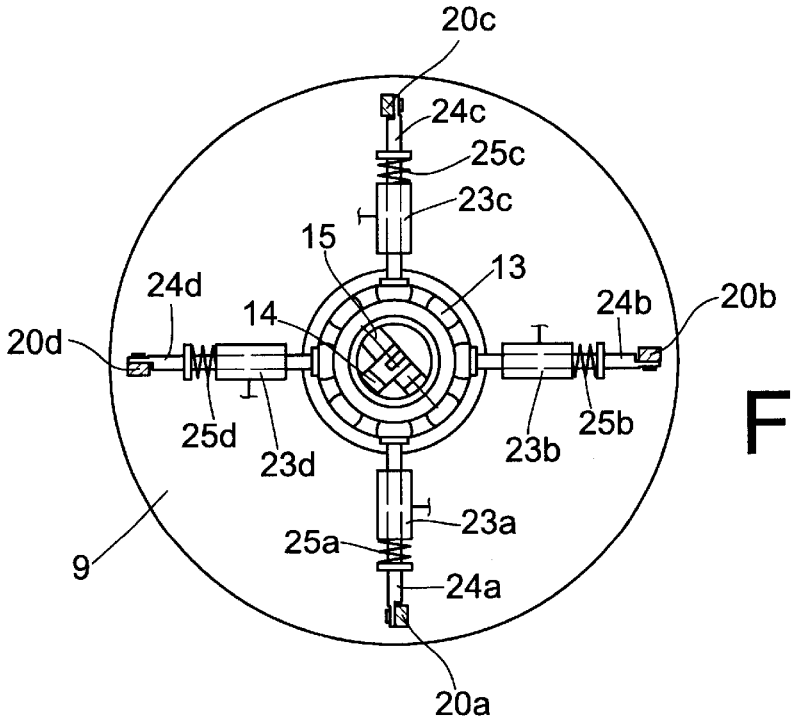
FIG. 6 is a sectional view along line VI—VI of FIG. 5.

FIGS. 5 and 6 show another embodiment of the invention in which four entraining elements 19*a* to 19*d* are arranged on four respective pivotable holders 20*a* to 20*d*. Holders 20*a* to 20*d* can pivot about pivot shafts 22*a* to 22*d* by means of solenoids 23*a* to 23*d*. Thrust rods 24*a* to 24*d* are actuated by solenoids 23a to 23d. These thrust rods engage into oblong holes 21*a* to 21*d* in holders 20*a* to 20*d*. Thrust rods 24*a* to 24*d* are urged outwardly in the resting state by springs 25*a* to 25*d*, as a result of which entraining elements 19*a* to 19*d* are held out of contact with spinning rotor 1. Entraining elements 19*a* to 19*d* are pivoted inward by actuating solenoids 23*a* to 23*d* against the exterior of spinning rotor 1 at the location of the largest diameter of spinning rotor 1.

In such position as shown in FIG. 5, entraining elements 19*a* to 19*d* are held in contact against the outermost diameter of spinning rotor 1 so that the spinning rotor can be driven by rotary drive 4 without an axial force component having to be exerted on spinning rotor 1, in contrast to the previously described exemplary embodiments.

The power supply of solenoids 23*a* to 23*d* is only schematically indicated in the drawings and can be accomplished in any suitable manner, e.g., by a sliding contact (not shown here) on drive housing 5. An inductive coupling is also conceivable. However, a special variant of the power supply is not a critical aspect of the present invention.

Figure 7:
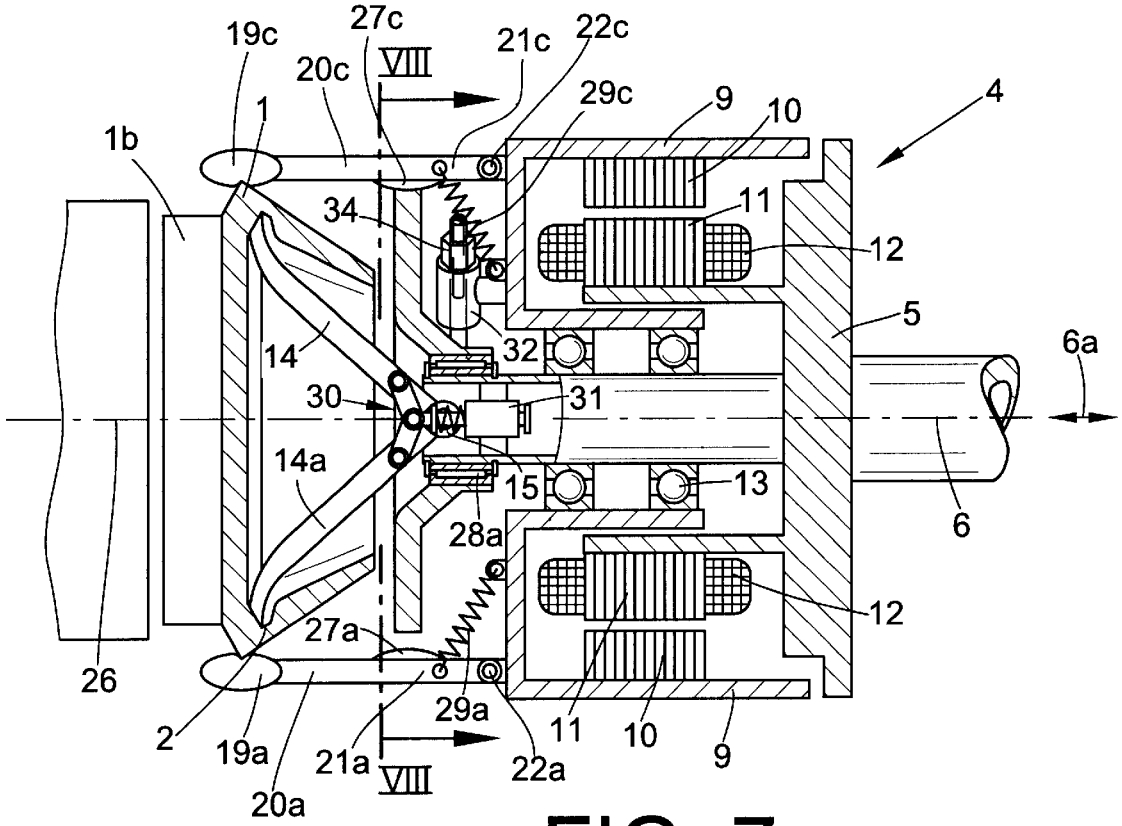
FIG. 7 is another sectional view similar to FIGS. 1, 3 and 5 through a rotary drive for a spinning rotor during its cleaning, in accordance with a fourth variant of the present invention.
Figure 8:
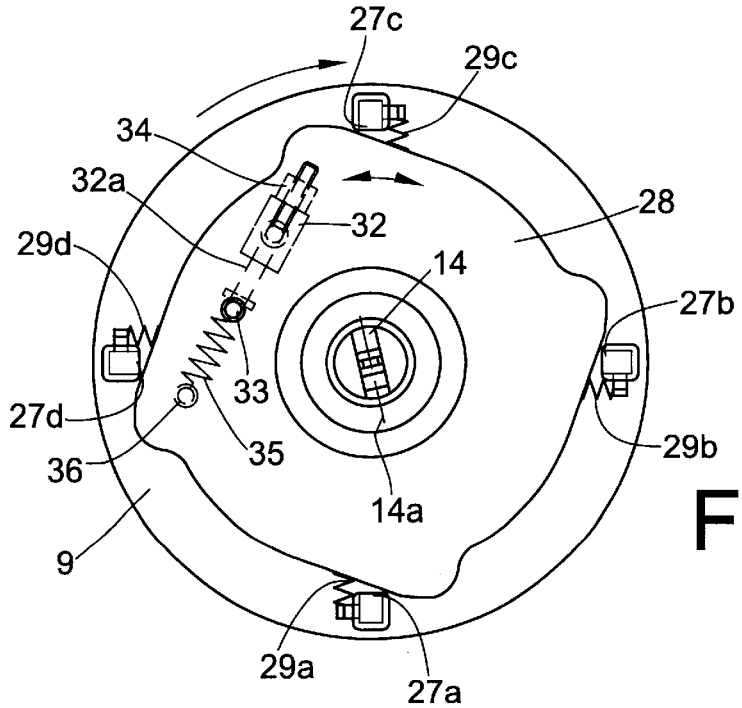
FIG. 8 is a sectional view along line VIII—VIII of FIG. 7.

FIGS. 7 and 8 show another embodiment of the invention in which, in comparison to the previously described embodiment, the control of holders 20*a* to 20*d* takes place in a modified form with entraining elements 19*a* to 19*d*. Thus, eccentric disk 28 is rotatably mounted on the central part of drive housing 5 by means of support 28*a*. This eccentric disk comprises sections with an enlarged radius that make contact with reinforcements 27*a* to 27*d* of holders 20*a* to 20*d* during the rotation of eccentric disk 28. In this manner, holders 20*a* to 20*d* are shifted outward against the force of tension springs 29*a* to 29*d*, as a result of which, entraining elements 19*a* to 19*d* come out of contact with spinning rotor 1 after the rotor cleaning.

In the view in FIGS. 7 and 8, eccentric disk 28 is out of engagement with holders 20*a* to 20*c* and reinforcements 27*a* to 27*d*. As a result, entraining elements 19*a* to 19*d* rest on rotor 1. Eccentric disk 28 can be rotatably indexed clockwise by electromagnet 32 fixed on electric rotor 9. This clockwise movement causes the sections of eccentric disk 28 with an enlarged radius to make contact with holders 20*a* to 20*d* and, as described, cause the entraining elements 19*a* to 19*d* to separate from spinning rotor 1. To this end, push rod 32*a* of electromagnet 32 is articulated to pin 33 fastened to eccentric disk 28. The basic position of push rod 32*a* in electromagnet 32 can be adjusted by adjustment screw 34. The pivoting of holders 20*a* to 20*d* can be adjusted in this manner. It can also be achieved in this manner that eccentric disk 28 still remains in contact with holders 20*a* to 20*d* even during the drive, as a result of which the full power of springs 29*a* to 29*d* does not act on holders 20*a* to 20*d*.

Moreover, tension spring 35 is attached to pin 33, which spring is suspended by its other end on another pin 36. This pin 36 is fastened in turn to electric rotor 9. Tension spring 35 draws push rod 32*a* after the deactuation of electromagnet 32 into the position shown in FIGS. 7 and 8.

Additionally and alternatively to the previous exemplary embodiments, a second scraper 14*a* is arranged opposite first scraper 14. Scrapers 14 and 14*a* can be pivoted simultaneously by scissors articulation 30. As an alternative, a linear magnetic drive 31 is also provided here for pivoting.

The invention is not limited to any certain embodiment, particularly as to the number and arrangement of pivot drives of the entraining elements as well as regards the number and pivot drives of the scrapers, as most of the exemplary embodiments already show.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. A rotary drive for use in conjunction with an arrangement for cleaning a spinning rotor having a tool for introduction into the rotor for cleaning contact with an interior rotor surface to be cleaned, the rotary drive comprising an entraining device for contact with an exterior rotor surface for imparting rotary movement to the spinning rotor during cleaning, the entraining device being arranged relative to the spinning rotor to mutually cancel radial forces generated by the rotary drive and the spinning rotor by the contact therebetween when the rotary drive and the spinning rotor respectively rotate about a common axis of rotation.

2. The rotary drive according to claim 1, characterized in that the entraining device comprises a closed circular ring oriented at a right angle to the common axis.

3. The rotary drive according to claim 1, characterized in that the entraining device comprises at least three entraining elements in an equally spaced circular arrangement oriented at a right angle to the common axis.

4. The rotary drive according to claim 1, characterized in that the entraining device is attached directly to an electric rotor of the rotary drive.

5. The rotary drive according to claim 1, characterized in that the rotary drive comprises an outside rotor motor having a non-rotating shaft, the cleaning tool being held in the non-rotating shaft.

6. The rotary drive according to claim 1, characterized in that the entraining device comprises a gripping surface at least on a portion thereof for contact with the spinning rotor.

7. The rotary drive according to claim 1, characterized in that the entraining device comprises an elastic material.

8. The rotary drive according to claim 7, characterized in that the entraining device includes a rubber magnet material.

9. The rotary drive according to claim 1, characterized further by a positioning device for selectively shifting the rotary drive toward and away from the spinning rotor along the common axis of rotation.

10. The rotary drive according to claim 9, characterized in that the positioning device comprises a control device for adjusting an engagement force of the entraining device against the spinning rotor.

11. The rotary drive according to claim 3, characterized in that the entraining elements are arranged to be pivotable essentially radially inwardly into engagement with an outermost diameter of the spinning rotor.

* * * * *